United States Patent [19]

Moore et al.

[11] Patent Number: 4,609,115

[45] Date of Patent: Sep. 2, 1986

[54] TAMPER-EVIDENT CLOSURE AND BOTTLE ASSEMBLY

[75] Inventors: David N. Moore, Plainfield; Bridgett Zemlo, Glendale Heights, both of Ill.

[73] Assignee: Phoenix Closures, Inc., Naperville, Ill.

[21] Appl. No.: 734,580

[22] Filed: May 15, 1985

[51] Int. Cl.[4] ..... B65D 41/34

[52] U.S. Cl. ..... 215/252; 215/31

[58] Field of Search ..... 215/252, 31

[56] References Cited

U.S. PATENT DOCUMENTS 3,504,818 4/1970 Crisci et al. .

3,874,540 4/1975 Hidding .

4,062,466 12/1977 Conti .

*Primary Examiner*—Donald F. Norton

*Attorney, Agent, or Firm*—Welsh & Katz, Ltd.

[57] ABSTRACT

A tamper-evident container closure and container assembly with tamper-evident ring which breaks away from the cap as the cap is unscrewed. The cap includes a pawled ring with a plurality of breakable connectors and connection of the pawl tips to the cap providing coupling of the ring to the cap. During assembly, the pawls ride over ratchet teeth on the container breaking the pawl connections to the container. When the cap is removed, the pawls interlock with the ratchet teeth breaking the breakable connectors. The ratchet teeth may be arranged in two sets of teeth offset from one another to provide reduced back-off and reduced back-off torque.

12 Claims, 7 Drawing Figures

3
3
5
5
4
4
10
12
14
16
18
20
22
24
26
28
29
32

TAMPER-EVIDENT CLOSURE AND BOTTLE ASSEMBLY

This invention relates to tamper-evident container closures and more particularly to an improved bottle assembly and closure cap with tamper-evident ring.

Tamper-evident container closures are widely used in consumer markets, particularly the dairy industry, to demonstrate to the final consumer that the contents of a container have not been contaminated or adulterated subsequent to bottling and capping. One type of prior art tamper-evident container closure employs a separable ring member having a plurality of triangular pawls to prevent such tampering. The ring is coupled to the cap by frangible elements located at discrete points around the cap. When the cap is twisted open, the pawls of the ring lock into engagement with the corresponding teeth on the container, breaking the frangible elements and separating the ring from the cap.

One problem with these types of structures is that the separable ring is connected to the cap fairly fragilely and therefore can sometimes separate from the cap prior to installation on the container, for example during shipping or handling operations. Increasing the strength or number of the frangible elements increases the effort required by the consumer to open the bottle. In addition, some of the prior art container closures allow significant undesirable back-off, thereby reducing the seal effectiveness.

It is accordingly an object of the present invention to provide a tamper-evident closure and bottle assembly having a separable ring with increased pre-installation strength.

It is another object of the invention to provide a tamper-evident closure and bottle assembly having a separable ring with controlled back-off torque required for removal.

It is yet another object of the invention to provide tamper-evident closure and bottle assembly having a separable ring with reduced back-off.

It is another object of the invention to provide a tamper-evident closure and bottle assembly having separable ring including evenly spaced pawls and having two offset series of ratchet teeth on the container.

Briefly, according to one embodiment of the invention, a tamper-evident container closure and container assembly is provided comprising a plurality of ratchet teeth members adjacent the threaded mouth portion of the container. A threaded closure for engaging threaded mouth portion of the container is provided along with a ring frangibly coupled to the threaded closure by a plurality of frangible elements disposed between a plurality of pawls, each pawl frangibly connected to said threaded cap for interlockably engaging said plurality of ratchet teeth members on said container when the closure is rotated in the direction of cap twist-off.

BRIEF DESCRIPTION OF THE DRAWINGS

The invention, together with further objects and advantages thereof, may be understood by reference to the following description taken in conjunction with the accompanying drawings.

DETAILED DESCRIPTION OF THE PREFERRED EMBODIMENT

Figures 1, 2, 3:
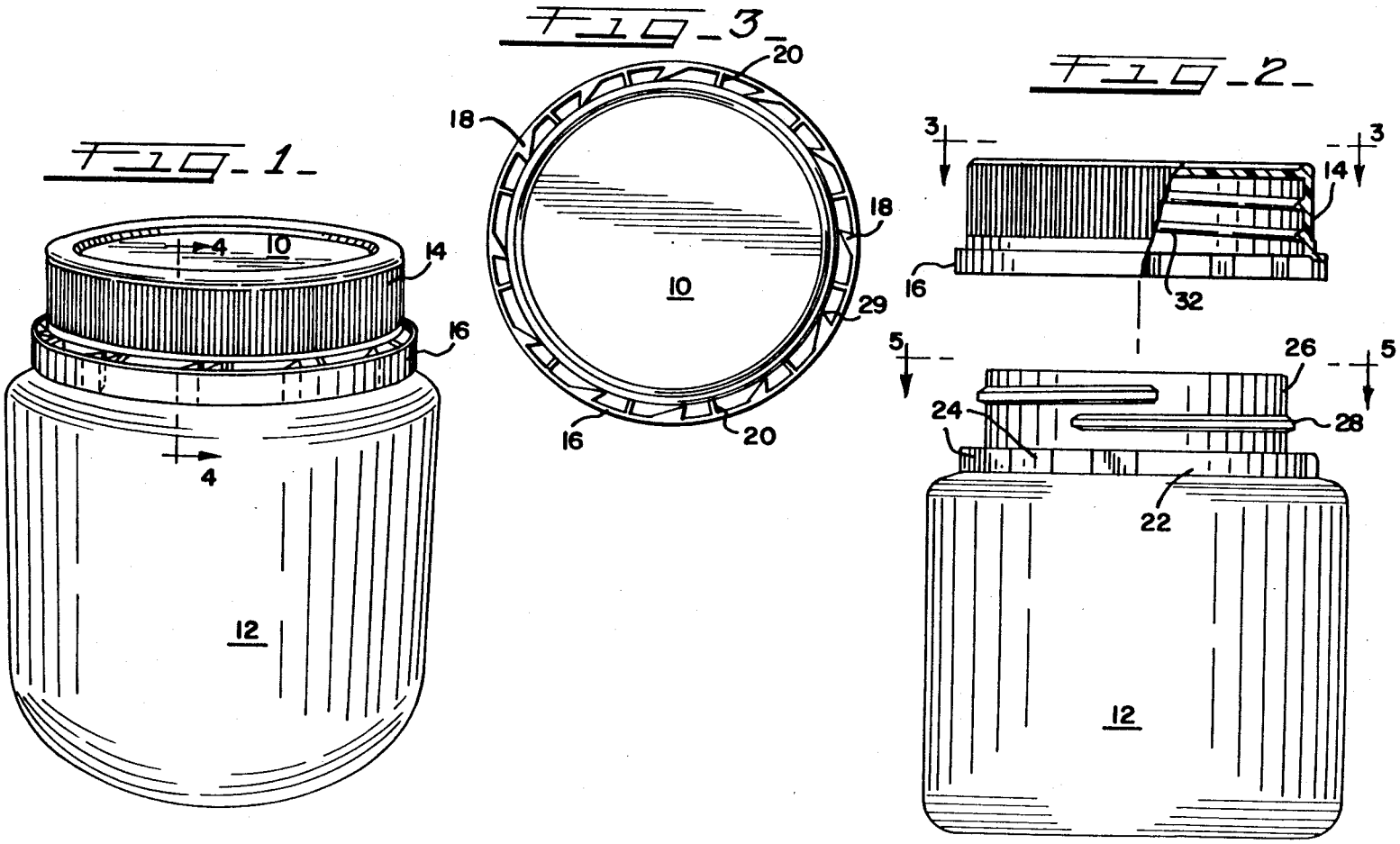
FIG. 1 is a perspective view showing a specific embodiment of the novel tamper-evident closure and container assembly of the invention.
FIG. 2 is a side view of the bottle enclosure of FIG. 1 with the closure shown in a partial sectional view as it would appear prior to assembly with the container.
FIG. 3 is a top view of the closure from the perspective indicated by the directional arrows 3—3 of FIG. 2.

Referring to FIG. 1 there is shown a perspective view of a specific embodiment of the novel tamper-evident closure 10 assembled with a container 12 in accordance with the invention. The closure 10 comprises a threaded cap body 14 with a tamper-evident ring 16 frangibly coupled to the cap body 14. Entire closure 10 is preferably fabricated in the illustrated embodiment, of molded flexible plastic material, such as polyethylene or polypropylene.

Figure 4:
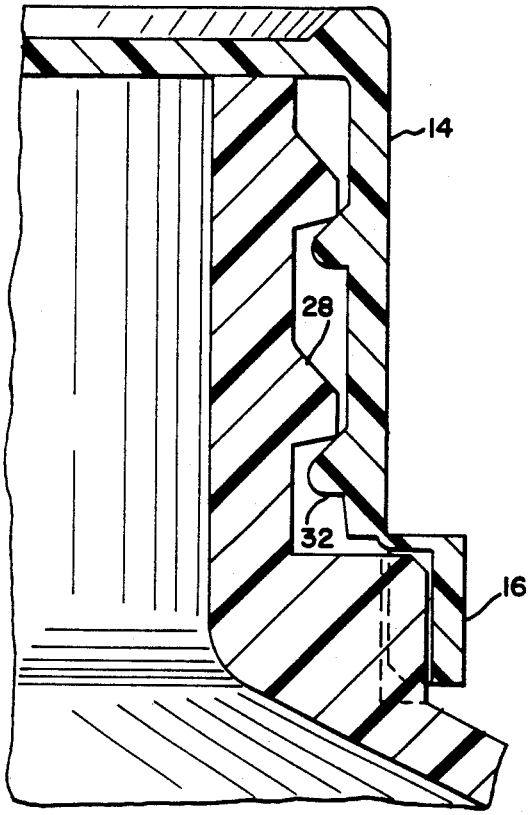
FIG. 4 is an enlarged sectional view of the container threaded mouth portion with closure mounted thereon as shown in FIG. 1.
Figure 5:
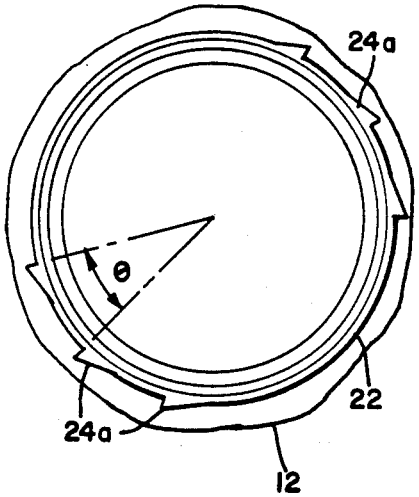
FIG. 5 is a top view of the container of FIG. 1 showing offset sets of ratchet teeth for reduced removal torque.
Figure 6:
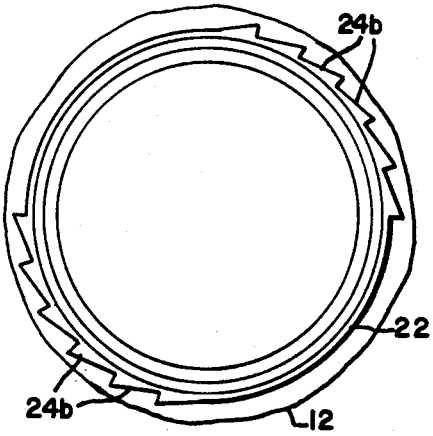
FIG. 6 is a top view of the container showing ratchet teeth with reduced angular separation between the ratchet teeth within each set of ratchet teeth.
Figure 7:
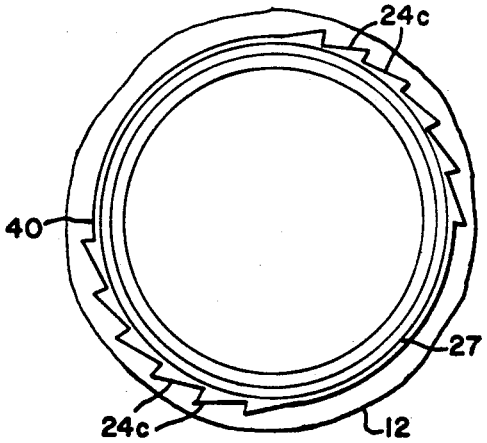
FIG. 7 is a top view of the container of FIG. 1 showing offset sets of ratchet teeth with reduced angular separation between the ratchet teeth within each set of ratchet teeth.

As shown in FIG. 2, the container 12 has a neck portion 26 having an external thread 28 formed thereon. In addition, a suitable number of generally triangular ratchet teeth 24 are fabricated on the outside surface of the shoulder 22 of the container neck 26 beneath the thread 28 and extending radially outward from the neck 26 (also see FIGS. 5, 6, 7). Clearly other shapes of ratchet teeth may be used. While a single ratchet tooth may be employed, in the illustrated embodiment a plurality of ratchet teeth 24 are arranged in two sections as shown in FIGS. 5, 6, and 7. As shown in FIG. 2 and 4, the cap body 14 is arranged with an internal thread 32 to co-act with the container external thread 28 so that turning the closure 10 in a twist-on direction results in assembly of the cap 14 onto the container 12, and turning the cap 14 in the opposite (twist-off) direction causes the cap 14 to back-off and be removed from the container 12.

The tamper-evident ring 16 of the closure 10 includes a plurality of generally triangular shaped pawls 18 extending radially inwardly on the inside surface of the ring 16 to engage one or more of the ratchet teeth 24 during cap removal, as best illustrated in FIG. 3. In addition, a set of radially extending breakable connectors 20 are provided about the circumference of the cap frangibly connecting the cap body 14 to the ring 16 at a point on the ring intermediate succeeding pawls as shown in FIG. 3. In the illustrated embodiment, the pawls 18 are angularly spaced at about 30° from each other with the breakable connectors 20 similarly spaced from one another between the pawls 18. In addition, the pawls 18 are also frangibly connected to the edge of the cap body 14 at the tip of each pawl 18, as indicated by the reference numeral 29. Thus, when the closure 10 is turned in a twist-on direction on the container 12, the pawsl 18 ride over the ratchet teeth 24 which thereby breaks the connection of the pawl tips to the cap body 14 while the breakable connectors 20 intermediate the pawls remain intact to maintain continuation and integrity of the connection of the cap body 14 to the ring 16. Connection of the ring 16 to the cap body at both the pawl and intermediate the pawls provides a substantial increase in the strength and integrity of the closure in storage etc., prior to assembly on the container while avoiding an increase in the torque required for a consumer to remove the cap from the container.

Once the closure 10 is assembled with the container 12, the breakable connectors 20 join the cap body 14 with the ring 16 to ensure that the pawls 18 engage in full locked relationship with the ratchet teeth 24 and to indicate the status of the contents of the container 12 i.e., indicate the existence of tampering or adulteration of the container contents. The connector 20 thus provides a frangible connection between the body cap 14 and the ring 16 which holds the pawls 18 in engagement with the ratchet teeth upon the turning of the cap body 14 in a twist-off direction, thereby preventing pawls 18 from riding out of engagement with the ratchet teeth.

Referring now to FIG. 5, there is shown a top view of a specific embodiment of the container 12 illustrating one arrangement of the ratchet teeth 24*a*. As shown, the ratchet teeth 24*a* are arranged in two sets of ratchet teeth with the teeth within each set spaced from one another by approximately 30 degrees (i.e. $\theta=30$ degrees as shown in FIG. 5). Conventionally, the two sets of ratchet teeth are uniformly spaced in an opposing configuration such that each tooth of one set has a corresponding tooth spaced 180° away. This configuration provides tamper protection by engaging the pawls 18 of the closure 10 when an attempt is made to remove the cap 14. However, due to the 30 degrees arc between the teeth and the uniform, opposing spacing, the cap can be turned in the twist-off direction through the 30 degree arc without engaging the ratchet teeth. This is referred to as back-off. Thus, as shown in FIG. 5 (and FIG. 7) the two sets of ratchet teeth are offset from one another a predetermined angular differential (i.e. approximately half the tooth spacing in the illustrated embodiment). This configuration reduces the back-off by half because only half as much back-off movement will result in engagement of one or the other set of ratchet teeth with the corresponding pawls. Further, the offset configuration causes only one set of teeth to be engaged at any instant during removal of the cap body 14. Thus, in the illustrated embodiment, only three teeth will be engaged at any instant during removal, reducing the number of breakable connectors 20 that are stressed and broken by the back-off torque at any one instant during removal of the cap. This reduces the back-off torque required to remove the cap 14 resulting in greater ease of use by the consumer.

In order to reduce back-off, an alternate configuration may be used, as shown in FIGS. 6 and 7. In FIG. 6, back-off is reduced by reducing the spacing between the ratchet teeth 24*b* in half to 15 degrees. This reduces back-off in half relative to a container with 30 degrees ratchet tooth spacing and no offset. In FIG. 7, the spacing between ratchet teeth 24*c* is reduced to 15 degrees and an offset of approximately 7-½ degrees is also provided. This configuration both minimizes back-off thereby assuring the retention of a seal while simultaneously reducing the torque required to break the breakable connectors 20. Thus, from an examination of FIG. 5, 6 and 7, it can be seen that back-off and removal torque can be independently controlled by appropriate use of offset and reduced tooth spacing.

In use the cap body 14 is turned onto the neck portion 26 of a filled container 12 in the conventional manner, the pawls 18 riding over the ratchet teeth 24 causing the frangible connection 29 between the ratchet teeth and the cap body 14 to break while the breakable connectors 20 remain intact, thus keeping the pawls in engagement with the ratchet teeth and indicating the lack of tempering. At a later time, such as after purchase of the container contents, when it is desired to gain access to the contents of the container 12, the cap body 14 is grapsed and rotated in the twist-off direction to unseat the cap thread 32 from the container thread 28. Upon application of sufficient torque by the consumer, with the pawls 18 in engagement with at least some of the ratchet teeth 24, the connectors 20 will be broken and the ring 16 will drop away, providing a highly visible indication that the bottle has been opened. The cap body 14 may then be turned off the bottle and used afterwards for reclosure, while the ring 16 is discarded.

A specific embodiment of the novel container assembly and tamper-evident closure has been described for the purpose of illustrating the manner in which the invention may be made and used. It should be understood that implementation of other variations and modifications of the invention in its various aspects will be apparent to those skilled in the art and that the invention is not limited by the specific embodiments described herein. It is therefore contemplated to cover by the present invention any and all modifications, variations, or equivalents that fall within the true spirit and scope of the basic underlying principle disclosed and claimed herein.

What is claimed is:

1. A tamper-evident container closure and container assembly, comprising:

a container having a threaded mouth portion;

a plurality of ratchet teeth members adjacent said mouth portion;

a threaded cap for engaging the threaded mouth portion of said container;

a ring frangibly coupled to said threaded cap by a plurality of frangible connector elements disposed between a plurality of pawls, at least one pawl frangibly connected to said threaded cap for interlockably engaging said plurality of ratchet teeth members on said container when the cap is rotated in the direction of cap twist-off and wherein the frangible connection of the pawl to the threaded cap are broken when the cap is rotated in the direction of cap twist-on.

2. The tamper-evident container closure and container assembly of claim 1 wherein the ratchet teeth are formed in a first section of ratchet teeth, and a second section of ratchet teeth, each section comprising at least one ratchet tooth.

3. The tamper-evident container closure and container assembly of claim 2, wherein a diameter line passing through a radial surface of one ratchet tooth is angularly offset from the radial surface of an opposed corresponding ratchet tooth.

4. The tamper-evident container closure and container assembly of claim 2 wherein the pawls are spaced at approximately 30° spacing from one another and wherein the ratchet teeth within each section of ratchet teeth are spaced from one another by approximately 30 degree spacing.

5. The tamper-evident container closure and container assembly of claim 2 wherein the pawls are spaced at approximately 30° spacing from one another and wherein the ratchet teeth within each section of ratchet teeth are spaced from one another by 15°.

6. The tamper-evident container closure and container assembly of claim 1 wherein there is at least one frangible connector element disposed between each two adjacent pawls.

7. A tamper-evident closure for use with a container having a threaded mouth portion and a plurality of ratchet teeth members adjacent said mouth portion, said closure comprising:

a threaded cap body for engaging the threaded mouth portion of said container;

a ring frangibly coupled to said threaded cap body by a plurality of breakable connectors radially disposed between a plurality of pawls each pawl frangibly connected to said threaded cap for interlockably engaging said plurality of ratchet teeth members on said container when the closure is rotated in the direction of cap twist-off and wherein the frangible connections of the pawls to the threaded cap body are broken when the cap body is rotated in the direction of the cap twist-on.

8. The tamper-evident closure of claim 7 wherein the breakable connectors are disposed at 30° intervals along the circumference of the ring.

9. A container for use with a tamper-evident closure having a ring frangibly connected to a cap body wherein the ring contains a plurality of pawls extending radially inward, comprising:

a threaded mouth portion for engagement with the threaded closure;

a plurality of ratchet teeth members adjacent said mouth portion and formed in at least two separate sets of ratchet teeth with each set comprising at least one ratchet tooth and a diameter line passing through a radial surface of one ratchet tooth being angularly offset from the radial surface of an opposed corresponding ratchet tooth.

10. The tamper evident container of claim 9, wherein each set includes a plurality of ratchet teeth.

11. The tamper-evident container of claim 10 wherein the ratchet teeth within each set of ratchet teeth are spaced from one another by approximately 15 degree spacing.

12. A tamper-evident container of claim 10 wherein a diameter line passsing through the radial surface of each tooth is angularly offset from the radial surface of said opposed corresponding tooth by an angular differential of approximately half the angular spacing between the ratchet teeth within each set of ratchet teeth.

* * * * *